United States Patent [19]

Dewhirst

[11] 3,938,559

[45] Feb. 17, 1976

[54] METHOD OF MAKING PILE FABRICS AND THE PILE FABRIC MADE THEREBY

[75] Inventor: Geoffrey Wilson Dewhirst, Broughty Ferry, Scotland

[73] Assignee: Thomson Shepherd and Company Limited, Angus, Scotland

[22] Filed: Nov. 29, 1974

[21] Appl. No.: 528,130

[52] U.S. Cl. ..... 139/7 R; 139/7 F

[51] Int. Cl.[2] ..... D03D 39/02

[58] Field of Search ..... 139/7 R, 7 A, 7 G, 2, 3, 139/4, 5, 6, 399, 400; 112/79 R, 79 A; 156/72

[56] References Cited

UNITED STATES PATENTS

| | | | |
|---|---|---|---|
| 872,507 | 12/1907 | Greenwood | 139/7 F |
| 897,528 | 9/1908 | Greenwood | 139/7 F |
| 1,828,921 | 10/1931 | Brinton | 139/7 F |
| 2,824,580 | 2/1958 | Haynes | 139/2 |
| 3,187,779 | 6/1965 | Smiley et al. | 139/7 F |

FOREIGN PATENTS OR APPLICATIONS

| | | | |
|---|---|---|---|
| 1,133,954 | 11/1968 | United Kingdom | 139/7 R |

*Primary Examiner*—James Kee Chi
*Attorney, Agent, or Firm*—Alan H. Levine

[57] ABSTRACT

A method of increasing the length of tuft to be woven into an Axminster carpet on a gripper loom. After the yarns have been drawn-off the yarn carriers by relative movement between the yarn carriers and the grippers, means, such as a finger mounted on the knife box, is caused to traverse the loom ahead of the knife and successively engage the drawn-off yarns thereby increasing the length of the tufts.

7 Claims, 9 Drawing Figures

METHOD OF MAKING PILE FABRICS AND THE PILE FABRIC MADE THEREBY

This invention relates to the method of increasing the tuft length in an Axminster gripper loom without making major adjustments to the gripper and or yarn carrier movement.

It has previously been the practice in gripper Axminster type looms to increase the tuft length with a gripper draw-off and fixed yarn carriage.

The present invention is designed to produce any lengths of tuft within the normal practical limitations of the loom in question.

This invention is based on the gripper method of inserting tufts into a foundation structure woven concurrently with the tuft insertion and has particular application for looms with a movable yarn carriage.

According to the invention there is provided a method of increasing the tuft length in an Axminster gripper loom having yarn carriers and a gripper associated with each carrier comprising drawing yarn off the carriers, after the grippers have closed on the yarns, by relative movement of the carriers and grippers, increasing the drawn-off length of the yarns by engaging said yarns with means movable relative to both carriers and grippers and subsequently cutting said yarns.

In a preferred embodiment of the invention, a pile lengthening finger, for example of metal, is attached to the knife box assembly in close proximity to the knife. The pile lengthening finger is ahead of the cutting knife and the distance between the finger and the cutting knife is predetermined but variable depending upon the amount of pile yarn required to form a tuft.

The method according to the invention can be applied to conventional looms without affecting the loom speed or the mechanical efficiency thereof.

Specific embodiments of the invention will now be described by way of example with reference to the accompanying drawings, in which.

In making a carpet on the gripper Axminster method of manufacture it is normal practice after the grippers have closed on the plurality of pile yarn threads selected by the jacquard and presented to the grippers for either the yarn carriers to move away from the gripper the required distance to provide sufficient yarn for the tuft length required, or alternatively, for the grippers to move away from the yarn carriers to provide sufficient yarn for the tuft length required.

When long pile or Rya type carpets are produced the distance that either the grippers or the yarn carriers must move to provide the yarn required for the tuft length is far greater than normal practice.

When the yarn carriers move away from the grippers to provide pile yarn for long tufts, there is greater possibility of variation in tension between the yarn carrier and the yarn supply package, with a detrimental effect on quality and production.

When the grippers move away from the carrier to provide pile yarn for long tufts, the radial movement of the grippers presents a less favourable angle of the pile yarn to the comb and cutting knife than in normal practice.

This invention allows sufficient pile yarn to produce long tufts with only conventional movement of the yarn carriers or gripper mechanism.

Figure 1A:
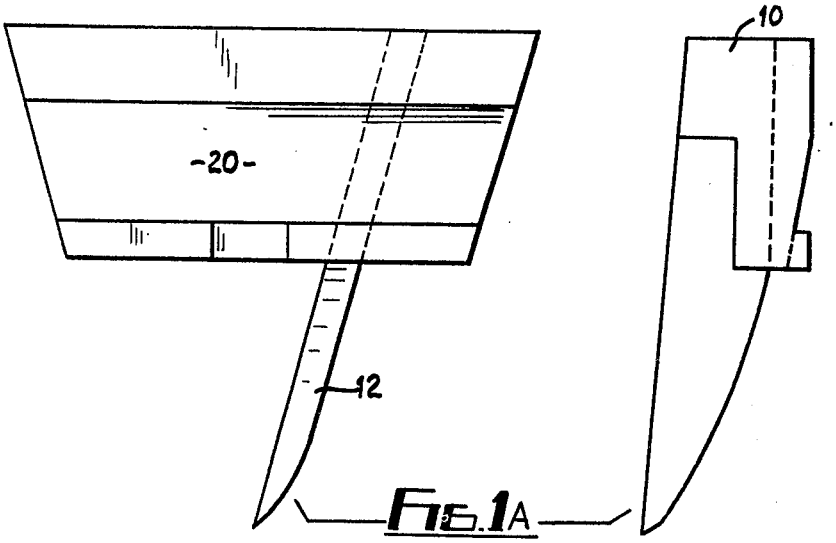
FIG. 1A shows a knife block knife in side and end elevation.
Figure 1B:
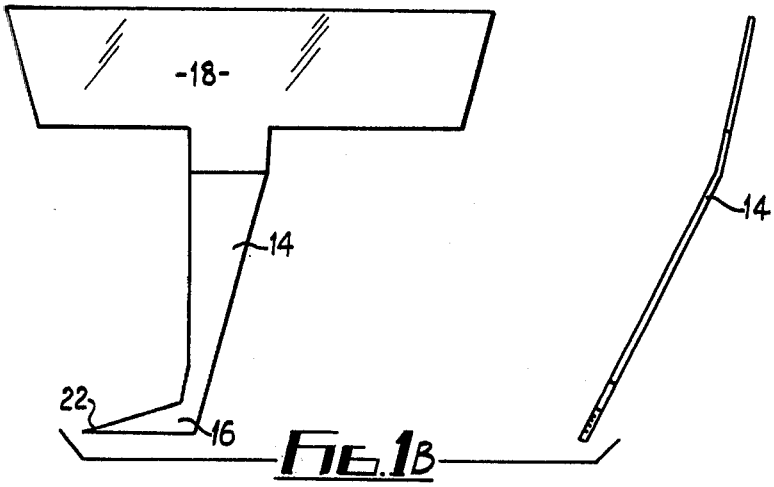
FIG. 1B shows a pile lengthening finger in side and end elevation.

Referring to FIG. 1A a brass knife block 10 has a steel cutting knife 12 attached to it. A pile lengthening finger is shown in FIG. 1B and comprises a flat strip 14 having a foot 16 at one end thereof and a mounting plate 18 at the other end which is receivable in a recess 20 in the block 10. The free end of the foot is tapered to a point 22.

Figure 3B:
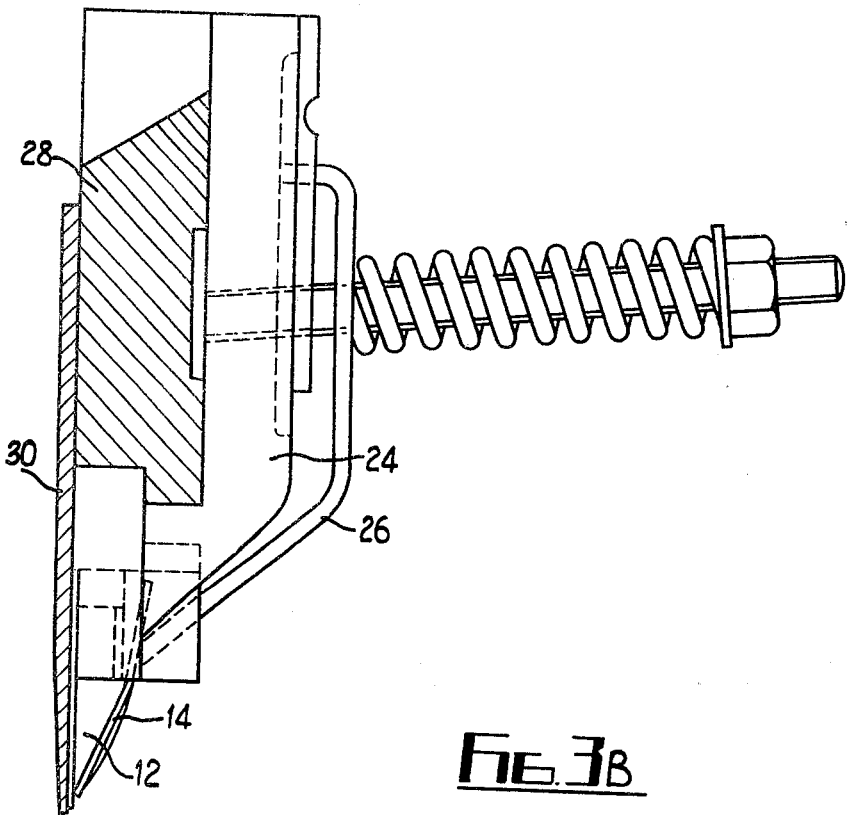
FIG. 3B shows the assembly of FIG. 3A in part sectional side elevation.
Figure 1C:
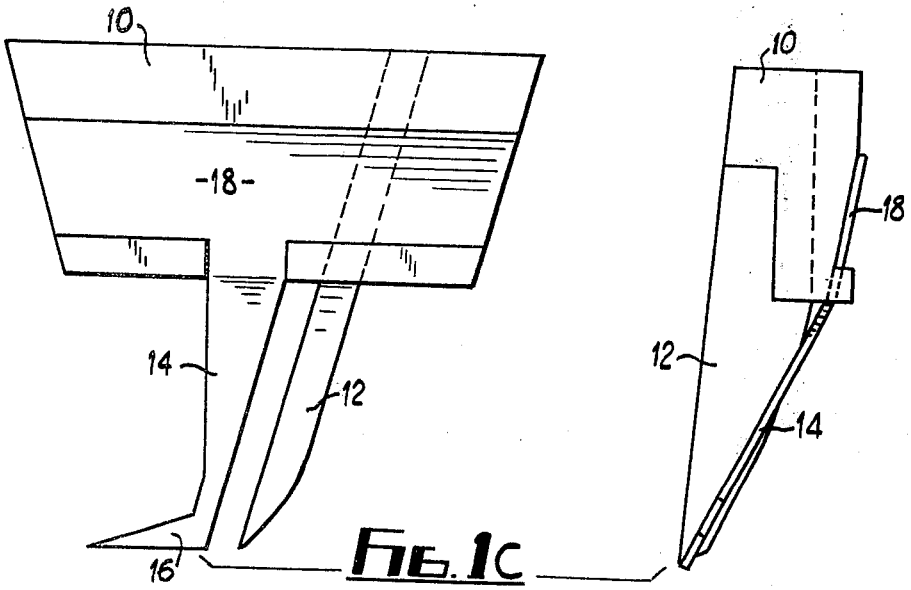
FIG. 1C shows the knife and pile lengthening finger of FIGS. 1A and 1B combined in both side and end elevation.
Figure 3A:
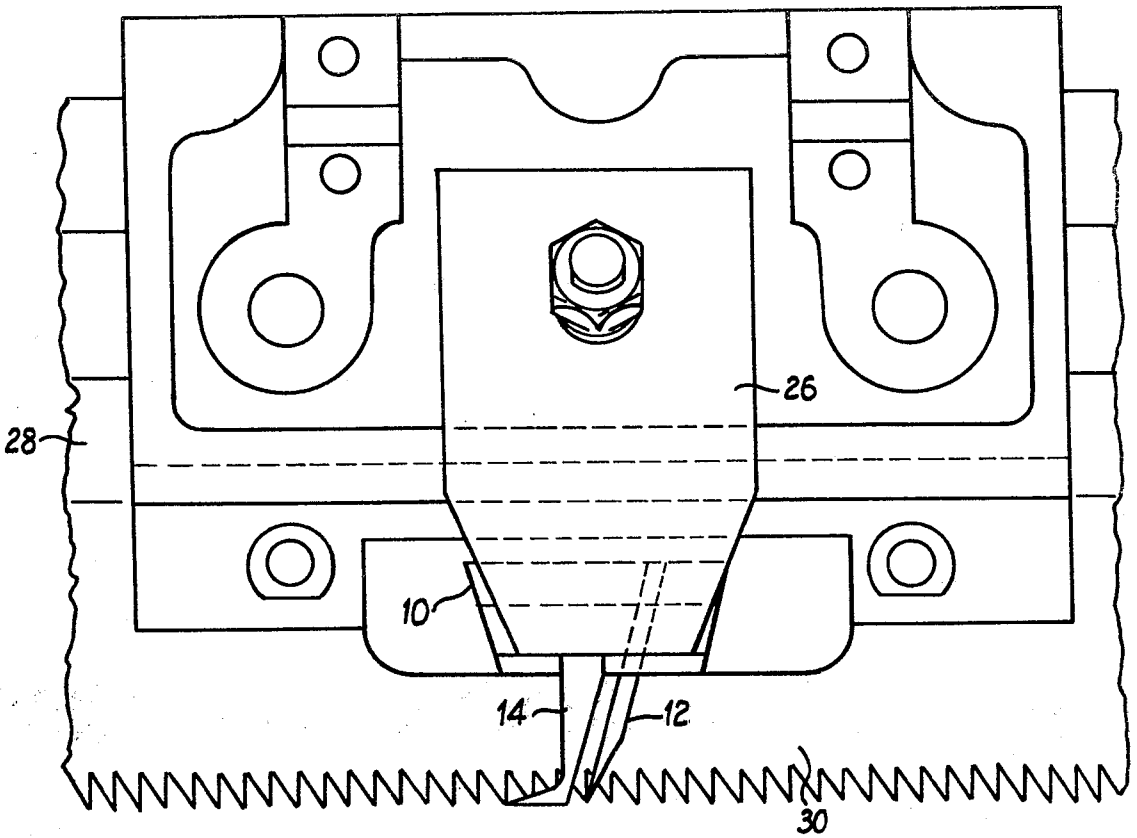
FIG. 3A is a knife box assembly with pile lengthening finger in side elevation.

The knife block 10 is mounted on a knife box assembly 24 (FIGS. 3A and 3B) in the usual way, but the pile lengthening finger is held in place by means of a spring loaded clamping plate 26 attached to the knife box.

As in conventional looms the knife box is adapted to move in a knife slide 28 to which a comb 30 is attached. It can be seen in FIGS. 3A and 3B that when the knife block moves along the slide (from right to left as viewed in FIG. 3A) to cut pile yarn threads that are in between the teeth of the comb, the foot of the pile lengthening finger moves ahead of the knife and engages in the pile yarns to increase the length thereof prior to cutting.

Figure 2:
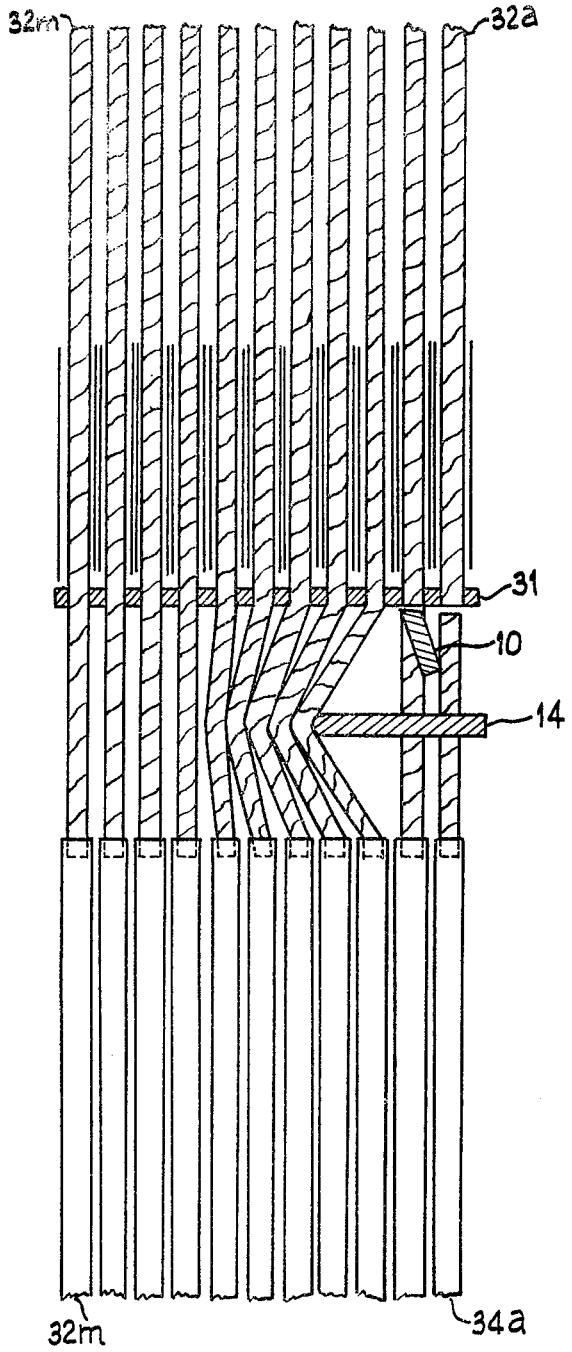
FIG. 2 is a diagrammatic representation of the lengthening of pile yarn.

This action can be seen more clearly in FIG. 2 which shows diagrammatically a yarn carrier 31 for pile yarns 32*a*–32*m*, which have been withdrawn from the carrier by grippers 34*a* –34*m* by an amount sufficient to produce low pile tufts. The knife 12 has already moved across the comb to sever the first two pile yarns 32*a* and 32*b*, but yarn 32*c* which has not yet been cut is engaged by the foot of the pile lengthening finger to withdraw additional yarn from the yarn carrier and provide a high pile tuft.

It will be understood that the shape of the pile lengthening finger and its position relative to the knife may be varied so as to provide lengths of tufts as desired. Thus, for example if the pile lengthening finger is moved away from the knife the tuft length is increased and if it is moved nearer the knife the tuft length is reduced.

A further advantage of the invention when used in conjunction with yarn carriage movement for producing tuft length in that through reduced movement of the yarn carrier away from the grippers, less variation in tension between the carrier and the pile yarn supply package occurs on pile yarns that have not been selected for the current row of pile being produced. This advantage is illustrated in FIGS. 4A–4C which are diagrammatic representations of the gripper, yarn carrier and pile yarn supply package.

Figure 4A:
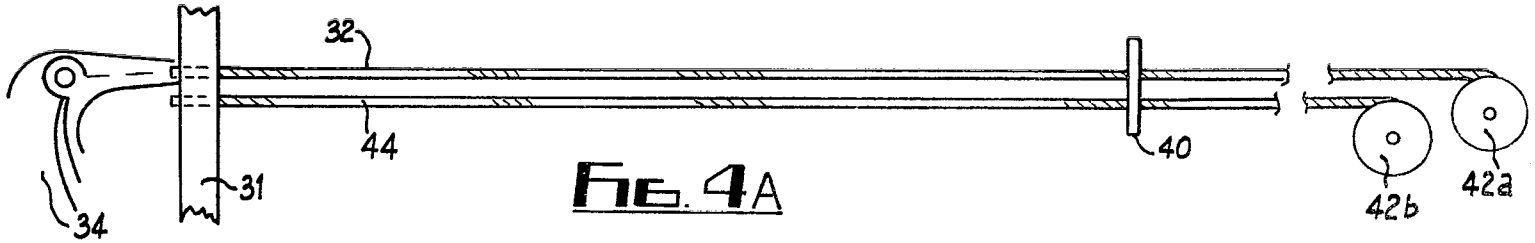
FIGS. 4A–4C are diagrammatic representations of the carrier movement compared with that of a conventional carrier.
Figure 4B:
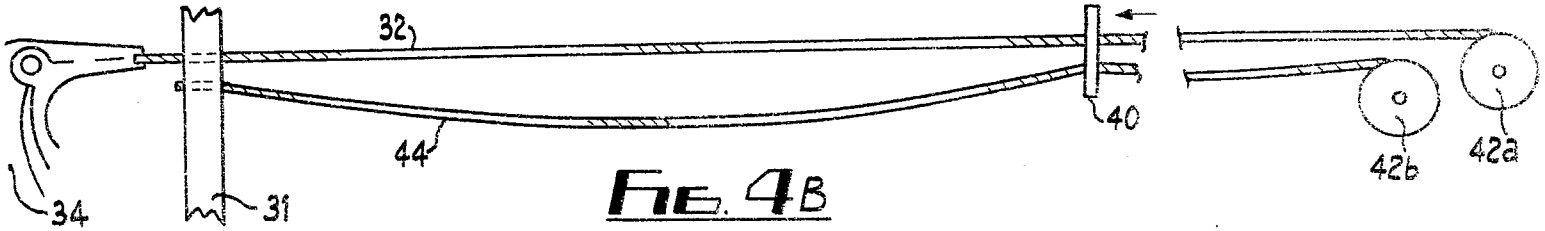
Figure 4C:
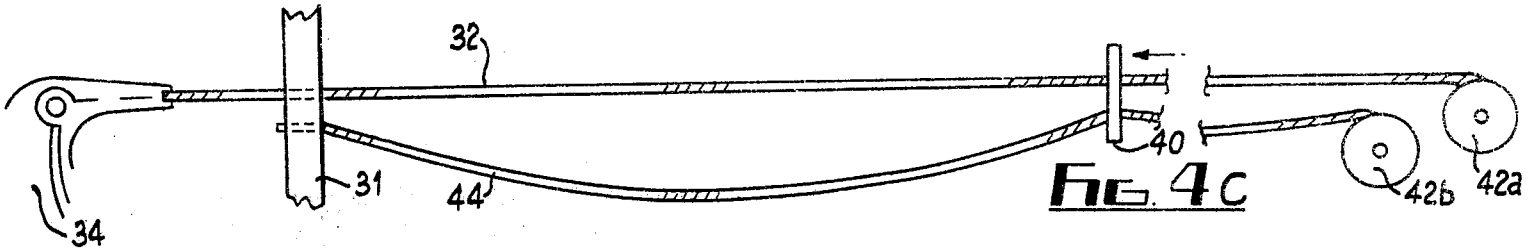

FIG. 4A is the neutral position with a gripper 34 engaging with pile yarn 32, supported in carrier 31.

40 is a yarn guide and 42*a* and 42*b* are pile yarn supply bobbins.

44 is a pile yarn that has not been selected for insertion into the carpet.

FIG. 4B shows the movements that take place for producing conventional pile on movable carriage looms, with the gripper 34 holding pile yarn 32. Carrier 31 has moved away from the gripper a sufficient distance to produce conventional low pile, and pile yarn 44, through not being selected has produced an amount of slackness between carriere 31 and yarn guide 40 and slackness to a lesser extent between yarn guide 40 and supply package 42*b*.

FIG. 4C shows the movements that take place for producing long pile on movable carriage looms with the gripper 34 holding pile yarn 32.

Carrier 31 has moved away from the gripper a significantly greater distance to produce long pile, and pile yarn 44, through not being selected has produced a much greater amount of slackness between carrier 31 and yarn guide 40, as compared to FIG. 4B.

With the use of a pile lengthening finger to produce long pile, the carrier movement would be the same as illustrated in FIG. 4B, with less slackness in the yarn than is illustrated in FIG. 4C.

What is claimed is:

1. A method of increasing the tuft length in an Axminster gripper loom having yarn carriers and a gripper associated with each carrier, comprising the steps of:

a. gripping a plurality of yarns in the grippers, b. drawing yarn off the yarn carriers by relative movement between the carriers and grippers, c. moving a cutting knife across the yarns to cut them, and d. moving a finger across the yarns simultaneously with movement of the cutting knife, the finger engaging each yarn and drawing additional yarn off its respective carrier prior to cutting of that yarn by the cutting knife.

2. A method as defined in claim 1 including the step of adjusting the distance between the finger and cutting knife prior to operation of the loom.

3. In an Axminster gripper loom having relatively movable yarn carriers and grippers for drawing lengths of yarn from the yarn carriers, an assembly comprising:

a. a cutting knife movable across the yarns to cut them, and b. a finger spaced forwardly of said cutting knife with respect to the direction of movement of the knife during cutting, said finger being movable with said cutting knife for engaging each yarn, to draw additional yarn off its respective carrier, before said cutting knife engages and cuts that yarn.

4. In an Axminster gripper loom, an assembly as defined in claim 3 wherein the spacing between said finger and cutting knife is adjustable.

5. In an Axminster gripper loom, an assembly as defined in claim 3 including a block movable crosswise of the yarns, said block carrying both said cutting knife and finger.

6. In an Axminster gripper loom, an assembly as defined in claim 5 including a recess in said block, said finger having a portion slidably arranged within said recess.

7. In an Axminster gripper loom, an assembly as defined in claim 6 including means resiliently pressing said finger portion against said block to hold said finger portion in any desired position of adjustment within said recess.

* * * * *